United States Patent [19]

Melville et al.

[11] 4,196,017

[45] Apr. 1, 1980

[54] METHOD FOR REDUCING COLOR IMPURITIES IN SUGAR-CONTAINING SYRUPS

[75] Inventors: James C. Melville, Tracy; Joseph M. Beatty, II, Tustin; Joe H. Satcher, Jr., Stockton, all of Calif.

[73] Assignee: Holly Sugar Corporation, Colorado Springs, Colo.

[21] Appl. No.: 7,024

[22] Filed: Jan. 29, 1979

[51] Int. Cl.[2] ..... C13D 3/08; C13D 3/12; C13D 3/00

[52] U.S. Cl. ..... 127/41; 127/46 R; 127/48; 127/55

[58] Field of Search ..... 127/46 R, 46 A, 48, 127/55, 41

[56] References Cited

U.S. PATENT DOCUMENTS

| | | | |
|---|---|---|---|
| 1,989,156 | 1/1935 | Sanchez | 127/48 |
| 2,381,090 | 8/1945 | Vincent | 127/46 R |
| 2,929,746 | 3/1960 | Assalini | 127/46 R |
| 3,632,446 | 1/1972 | Prince | 127/41 |
| 3,698,951 | 10/1972 | Bennett | 127/46 R |
| 4,076,552 | 2/1978 | Farag | 127/46 R X |

OTHER PUBLICATIONS

Chemical Abstracts, 47: 9643i (1953).
Chemical Abstracts, 82: 126857w (1975).

*Primary Examiner*—Sidney Marantz
*Attorney, Agent, or Firm*—Owen, Wickersham & Erickson

[57] ABSTRACT

A method for reducing color impurities in sugar-containing syrups. First, hydrogen peroxide is added to the syrup and mixed with it. Following that, a suitable cationic surfactant is added, ahd there is further mixing. After that, a suitable defecant is added, such as a mixture of calcium chloride and sodium carbonate, which react with each other to form calcium carbonate in the sugar solution. Activated vegetable carbon and diatomaceous earth are added and mixed. Then the solids are filtered out to obtain a purified sugar solution which may be used directly or may be inverted, as by conventional acid treatment, and then used.

15 Claims, 1 Drawing Figure

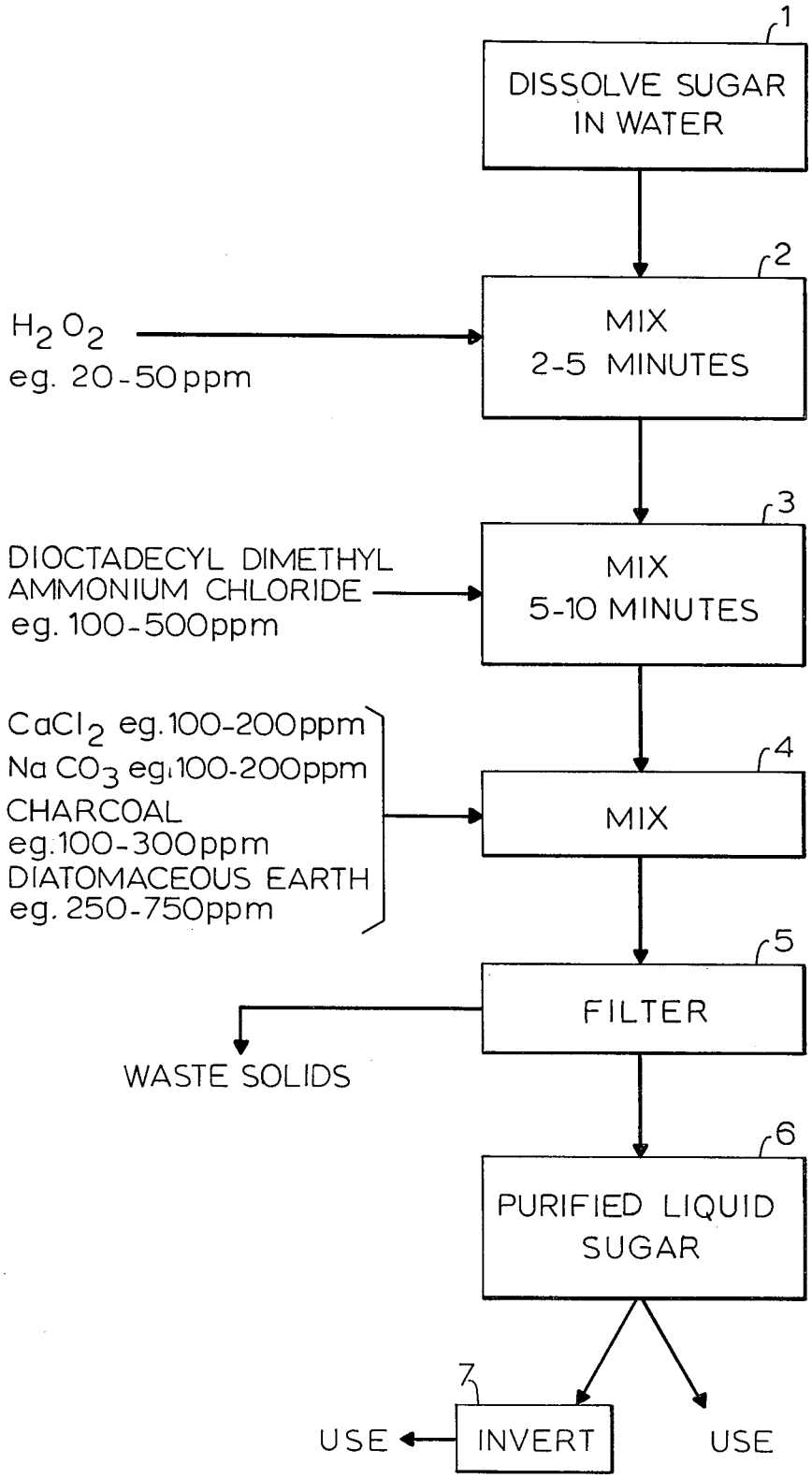
1
DISSOLVE SUGAR IN WATER
2
$H_2O_2$
eg. 20-50ppm
MIX 2-5 MINUTES
3
DIOCTADECYL DIMETHYL AMMONIUM CHLORIDE
eg. 100-500ppm
MIX 5-10 MINUTES
$CaCl_2$ eg. 100-200ppm
$NaCO_3$ eg. 100-200ppm
CHARCOAL
eg. 100-300ppm
DIATOMACEOUS EARTH
eg. 250-750ppm
4
MIX
5
FILTER
WASTE SOLIDS
6
PURIFIED LIQUID SUGAR
7
USE
INVERT
USE

METHOD FOR REDUCING COLOR IMPURITIES IN SUGAR-CONTAINING SYRUPS

BACKGROUND OF THE INVENTION

The invention relates to removing color impurities from syrups containing sugar. The sugar may be in the form of partially purified sugar, whether cane sugar or beet sugar, or may be raw sugar. It may be sugar that has supposedly been completely purified but yet retains too much color and too many impurities for proper marketing or use.

Heretofore, various materials have been used to purify sugar. Thus, calcium chloride and sodium carbonate which react in solution have been added as defecants; activated charcoal or other vegetable carbon has been added as absorbents; and diatomaceous earth has been added to enhance filtration. Also, as shown in U.S. Pat. No. 3,698,951, certain cationic surfactants, such as certain quaternary ammonium compounds with long hydrocarbon chains (including dihexadecylidimethyl and dioctadecyldimethyl quaternary ammonium compounds) have been used to remove anionic high molecular weight impurities, by forming an insoluble complex between the cationic surfactant and the anionic impurity. All of these things have helped to get better and purer sugar.

However, we have found that sufficient color reduction is not obtained by the use of the well-known cationic surfactants (quaternary ammonium compounds), even when they were combined with the use of suitable defecants, absorbents, and filtration enhancers.

It is also well known that certain oxidizing agents reduce color; in other words, they bleach materials by partial or complete degradation of colorant melecules. Hydrogen peroxide is one of these oxidizing agents, and it has been used to reduce the residual color of liquid sugar products. It has been found, however, that treatment in liquid sugar application by hydrogen peroxide does not produce a suitably stable product with respect to color. Thus, when treatment by hydrogen peroxide has been followed by storage, the color has tended to come back again.

COLOR UNITS AND INDEX OF CLARITY

Certain units which are used in the specification may require explanation. One of these is referred to herein as R.B.U. which means "reference base units". This may be defined as follows:

$$R.B.U. = \frac{\text{Absorbency at } 420\ nM - 2 \times A\ 720\ nM}{\underset{\text{(grams)}}{\text{cell length}} \times \underset{\text{(grams per milliliter)}}{\text{solids concentration}}}$$

Another unit is known as the "index of clarity" which is defined herein as the percentage of transmission at 720 nM.

Accelerated storage tests of prior-art use of hydrogen peroxide to reduce residual color of liquid sugar Referring to the units above, a seven-day accelerated storage test began by the treatment of syrup containing approximately 66.5% sucrose in an impure state with hydrogen peroxide at 0.025% (by weight of the sucrose) and activated charcoal at 0.02% (by weight of the sucrose) followed by filtering the sugar and then storing it for seven days at 50° C. The results were as follows:

TABLE I

| STATE OF READING | R.B.U. | INDEX OF CLARITY |
|---|---|---|
| Initial color of syrup | 108 | 81 |
| Immediately following treatment and filtering | 66 | 100 |
| Color after 7 days storage at 50° C. | 98 | 96 |

We thus found that treatment with hydrogen peroxide, even in conjunction with an activated charcoal, does not give satisfactory results.

SUMMARY OF THE INVENTION

The invention comprises initial treatment by a suitable oxidizing agent or bleach, hydrogen peroxide being presently preferable, followed by treatment with the cationic surfactant color-removing agent and then, following that, treatment with the usual defecants, absorbents, and filtration enhancers, and then filtering. We have found that such an incorporation of hydrogen peroxide, for example, removes color from sugar-containing fluids over and above that which is removed with the ingredients which are added later in this process. In other words, the previous addition of the hydrogen peroxide accomplishes the desired result when followed by use of the other materials.

As stated above, hydrogen peroxide is not satisfactory when used substantially alone, or even with carbon, nor are the other materials. However, the present process does give satisfactory results. Thus, treatment of sugar-containing fluids with hydrogen peroxide when followed by treatment with a cationic surfactant such as long hydrocarbon quaternary ammonium compounds and by the use of carbon and mild lime defecation, results in stable sugar fluid color.

In place of hydrogen peroxide, other suitable oxidants, such as ozone or a hypochlorite, may be used.

Other objects and advantages of the invention will appear from the following description.

BRIEF DESCRIPTION OF THE DRAWINGS

In the drawings:

The drawing is a flow sheet illustrating a preferred process embodying the principles of the invention.

DESCRIPTION OF A PREFERRED EMBODIMENT

The process begins with step1: dissolving the sugar in water if it is in a solid form. It is desirable to obtain a solution of sugar in which the sucrose concentration is between 50 and 80 percent. This can be done, for example, by dissolving a raw or partially purified, even mostly purified, sucrose in water at 80° C. This temperature can be maintained over the entire process, or the temperature can drop somewhat during treatment so long as it does not drop too low. If the temperature drops, somewhat longer periods may be required for reaction.

In step 2, the bleach or oxidizing agent, preferably hydrogen peroxide ($H_2O_2$), is added to the sugar solution. It may be added in amounts of from 5 to 1000 parts per million (ppm) by weight of the solids, i.e., the sugar solids. (All the parts discussed herein are by weight and are based on the amount of sucrose in the solution rather than the total weight of the solution.) We have found that effective ranges of addition to reduce color and produce a storable product are at their best between 20 and 50 ppm of the solids (by weight) which is 0.002–0.005 percent of the amount of solids. Addition of hydrogen peroxide is followed by a relatively short mixing time from 2–5 minutes with paddle mixers or other suitable mixing devices.

Next, the suitable cationic surfactant is added in step 3. This is preferably one of the materials shown in the Bennet U.S. Pat. No. 3,698,951 and comprises either a long hydrocarbon quaternary ammonium compound or a long hydrocarbon chain tertiary amine or a long hydrocarbon chain pyridinium compound. Presently preferred are the use of the quaternary ammonium compounds and of those the presently preferred ones are the dihexadecylidimethyl quaternary ammonium compounds and the dioctadecyldimethyl quaternary ammonium chloride, dioctadecyldimethyl ammonium chloride, and mixtures of them. Either dioctadecyldimethyl ammonium chloride or a mixture of dihexadecyl and dioctadecyldimethyl ammonium chloride is presently preferred, because it has been approved for use by the Food and Drug Administration. This material is preferably added in an amount from 50 to 750 ppm, depending on the amount of color present, typically 100–500 ppm. Again, there is a short mixing period of about 5–10 minutes.

After that, the defecant, absorbent, and filtration enhancer are added in step 4. For example, we prefer to use calcium chloride and sodium carbonate in amounts from 50–1000 ppm, normally in the range of 100–200 ppm. When added in more or less stoichiometric amounts, a typical amount would be 150 ppm of the calcium chloride and 138 ppm of sodium carbonate. Phosphating defecants tend to slow the filtration rate far too much, but are otherwise satisfactory. Again, the defecant should be one approved for use by the Food and Drug Administration.

The activated carbon, which may be activated charcoal, is not always necessary, but is often if not usually used. It can be omitted in cases where there is little to be absorbed. If used, it can be added in amounts of about 50–1000 ppm and diatomaceous earth is usually added at about 2½ times the amount of carbon, as a filter aid to provide an adequate filtration rate. For example, when 200 ppm were used, 500 ppm of diatomaceous earth was used. The amount of carbon added is a function of the color to be removed and of the filtration cycle requirements. The carbon also tends to reduce filter cycle time. Typical sugars that have been tried required between 100 and 300 ppm of activated carbon.

If desired, a filtration type polymer may be used to increase sediment particle size and thereby increase the filtration rate by that improved flocculation.

After this and mixing the filtration step 5 is carried out, preferably with such a filter that solids in sizes down to about 0.5 micron are removed. Any suitable pressure filtration device may be employed for this purpose, for example, filtering through a stainless steel perforated disc on which is supported a coarse filter paper and a layer of diatomaceous earth; with this example, at the start on a clean filter, recirculation may be necessary until the point is reached where solids larger than about 0.5 micron are removed.

After filtration, the purified liquid sugar 6 may be desired to invert the sugar by conventional acid treatment, as in step 7, or the syrup may be used directly without inversion. In either event, the syrup is then ready for the desired use. Ordinarily such sugar is used in the liquid state, although it may be solidified if that is desired by evaporation and crystallization as usual.

EXAMPLE 1

Referring back to Table I, it will be remembered that the use of hydrogen peroxide was not satisfactory when used only with the carbon, although it seemed good until it had been stored awhile. A similar test was tried after treatment with the present process.

Partially purified sucrose from cane sugar having an objectionable amount of color and impurities was dissolved at 80° C. to form a solution of about 66.5% sugar and 32.5% water. To this was added 40 ppm of hydrogen peroxide, and the resulting solution was mixed for about 4 minutes (Again, all parts are by weight as related to the solids [sugar] control). Then Talofloc was added at 50 ppm. After about 8 more minutes of mixing 150 ppm of calcium chloride, 138 ppm of sodium carbonate, 200 ppm of vegetable carbon (Darco), and 500 ppm of diatomaceous earth were added and mixed in. The solution was then filtered. After that, it was stored for 7 days at 50° C. in an accelerated storage test. The following results were obtained:

TABLE II

| STATE OF READING | R.B.U. | INDEX OF CLARITY |
|---|---|---|
| Initial color | 108 | 81 |
| Color after completion of treatment | 24 | 100 |
| Color after storage at 7 days | 24 | 100 |

EXAMPLE 2

Comparative tests have been run and are herein tabulated. A sugar solution with an initial sugar color of 96 R.B.U. and an index of clarity of 83 was treated in four different ways:

1. There was carbon treatment only of 200 ppm on solids, followed by filtration with a filter aid;
2. There was treatment by hydrogen peroxide at 30 ppm, calcium chloride at 50 ppm, sodium carbonate at 46 ppm, and activated carbon at 200 ppm;
3. There was treatment by Talofloc alone at 250 ppm along with calcium chloride at 50 ppm, sodium carbonate at 46 ppm, and carbon at 200 ppm; and
4. There was treatment with hydrogen peroxide plus all the ingredients of number 3. This is the process of the present invention.

The results were tabulated as follows:

TABLE III

| TYPE OF TREATMENT | R.B.U. | INDEX OF CLARITY |
|---|---|---|
| Initial sugar color - no treatment | 96 | 83 |
| 1. Carbon treatment only | 59 | 97 |
| 2. Hydrogen peroxide with $CaCl_2$, $Na_2CO_3$, and carbon | 36 | 99 |
| 3. Talofloc plus $CaCl_2$, $Na_2CO_3$ and carbon | 36 | 99 |
| 4. Hydrogen peroxide plus Talofloc, $CaCl_2$, $Na_2CO_3$, and carbon | 18 | 100 |

The great improvement in item 4 is significant to show that there is a synergistic action when both hydrogen peroxide and Talofloc are used, particularly in conjunction with the defecants and absorbents.

EXAMPLE 3

As stated above, it is possible to invert sugar at the end of the process. This also results in good results. In this particular example, sugar that was less pure than the one used in Example 2 and had, therefore, a higher R.B.U., was employed, so that the color reduction was not achieved to the full extent; but it is still remarkable. In this instance, the treatment for color removal comprised 30 ppm of hydrogen peroxide, followed by the Talofloc at 200 ppm, followed by calcium chloride at 50 ppm, sodium carbonate at 46 ppm, and carbon at 200 ppm, with 500 ppm of the diatomaceous earth as a filtration enhancer. The reading was taken after filtration. After that purification, standard acid treatment was used to invert the sugar and then the invert sugar was treated with additional 400 ppm of carbon and once again filtered. The results are tabulated as follows:

TABLE IV

| STATE OF TREATMENT | R.B.U. | INDEX OF CLARITY |
|---|---|---|
| Initial sugar color | 150 | 87 |
| Color treatment as stated above | 53 | 99 |
| Color after inversion | 36 | 99 |

Example 4

Example 1 is repeated using ozone at 50 ppm, in place of the hydrogen peroxide, and similar results are obtained.

EXAMPLE 5

Example 1 is repeated using sodium hypochlorite at 100 ppm, instead of the hydrogen peroxide, and similar results are obtained.

We claim:

1. A method for reducing color impurities in sugar-containing syrups comprising the steps of (1) adding to the syrup at about 80° C. an oxidizing bleach at 5–1000 ppm by weight per sugar content of the syrup, (2) mixing for about 2 to 5 minutes, (3) then adding thereto a cationic surfactant at 50 to 750 ppm by weight of said sugar content, (4) mixing for about 5 to 10 minutes, (5) then adding thereto a defecant and mixing thoroughly, and (6) then filtering the solids out to obtain a purified sugar solution.

2. The method of claim 1 wherein the syrup contains sucrose in an amount between 50% and 80% by weight.

3. The method of claim 1 wherein the purified solution obtained from step (6) is followed by inverting the sugar by treating it with acid to obtain a solution of invert sugar.

4. The method of claim 1 wherein the cationic surfactant is selected from the group consisting of long hydrocarbon chain quaternary ammonium compounds, long hydrocarbon chain tertiary amines, and long hydrocarbon chain pyridinium compounds.

5. The method of claim 4 wherein the cationic surfactant is selected from the group consisting of dihexadecyldimethyl ammonium chloride, dioctadecyldimethyl ammonium chloride, and mixtures thereof.

6. The method of claim 1 wherein between step (4) and step (6) activated carbon and a filter aid are mixed into the solution.

7. A method for reducing color impurities in sugar-containing syrups comprising the steps of (1) adding to the syrup at about 80° C. hydrogen peroxide at 5–1000 ppm by weight per sugar content of the syrup, (2) mixing for about 2 to 5 minutes, (3) then adding thereto a cationic surfactant at 50 to 750 ppm by weight of the sugar content, (4) mixing for about 5 to 10 minutes, (5) then adding thereto and mixing well therewith calcium chloride and sodium carbonate at 50 to 1000 ppm by weight of the sugar content each, and (6) then filtering the solids out to obtain a purified sugar solution.

8. The method of claim 7 wherein between steps (5) and (6) is the step of adding thereto and mixing therewith activated vegetable carbon at 50 to 1000 ppm by weight of the sugar content and diatomaceous earth at about 2½ times the amount by weight of carbon.

9. The method of claim 7 wherein the syrup contains sucrose in an amount between 50 and 80% by weight.

10. The method of claim 7 wherein the purified solution obtained from step (6) is followed by inverting the sugar by treating it with acid to obtain a solution of invert sugar.

11. The method of claim 7 wherein the cationic surfactant is selected from the group consisting of dihexadecyldimethyl ammonium chloride, dioctadecyldimethyl ammonium chloride, and mixtures thereof.

12. A method for reducing color impurities in sugar-containing syrups comprising the steps of (1) dissolving sucrose containing impurities in water at 80° C. to obtain a 50% to 80% by weight solution, (2) adding to the syrup at about 80° C., hydrogen peroxide at 20 to 50 ppm by weight per sugar content of the syrup, (3) mixing for about 2 to 5 minutes, (4) then adding thereto a cationic surfactant at 100 to 500 ppm by weight of said sugar content, (5) mixing for about 5 to 10 minutes, (6) then adding thereto calcium chloride and sodium carbonate at 100 to 300 ppm by weight of the sugar content each, and in a ratio of 138 parts of sodium carbonate per 150 parts of calcium chloride, (7) adding thereto activated vegetable carbon at 100 to 300 ppm by weight of the sugar content, and diatomaceous earth at about 2½ times the amount of carbon, (8) mixing for about 20 minutes, and (9) then filtering the solids out through a filter preventing passage of particles greater than ½ micron, to obtain a purified sugar solution.

13. The method of claim 12 wherein the purified solution obtained from step (9) is followed by inverting the sugar by treating it with acid to obtain a solution of invert sugar.

14. A method for reducing color impurities in sugar-containing syrups comprising the steps of (1) adding to the syrup at about 80° C., ozone at 5–1000 ppm by weight per sugar content of the syrup, (2) mixing for about 2 to 5 minutes, (3) then adding thereto a cationic surfactant at 50 to 750 ppm by weight of the sugar content, (4) mixing for about 5 to 10 minutes, (5) then adding thereto calcium chloride and sodium carbonate at 50 to 1000 ppm by weight of the sugar content each, (6) adding thereto activated vegetable carbon at 50 to 1000 ppm by weight of the sugar content and diatomaceous earth at about 2½ times the amount of carbon, (7) mixing thoroughly, and (8) then filtering the solids out to obtain a purified sugar solution.

15. A method for reducing color impurities in sugar-containing syrups comprising the steps of (1) adding to the syrup at about 80° C., sodium hypochlorite at 10–1000 ppm by weight per sugar content of the syrup, (2) mixing for about 2 to 5 minutes, (3) then adding thereto a cationic surfactant at 50 to 750 ppm by weight of said sugar content, (4) mixing for about 5 to 10 minutes, (5) then adding thereto calcium chloride and sodium carbonate at 50 to 1000 ppm by weight of said sugar content each, (6) adding thereto activated vegetable carbon at 50 to 1000 ppm by weight of said sugar content each and diatomaceous earth at about 2½ times the amount of carbon, (7) mixing thoroughly, and (8) then filtering the solids out to obtain a purified sugar solution.

* * * * *

UNITED STATES PATENT AND TRADEMARK OFFICE

CERTIFICATE OF CORRECTION

PATENT NO. : 4,196,017

DATED : April 1, 1980

INVENTOR(S) : James C. Melville, et al

It is certified that error appears in the above-identified patent and that said Letters Patent are hereby corrected as shown below:

Cover page, right hand column, item [57], Abstract, line 4, "ahd" should read --and--.

Column 1, line 22, "dihexadecylidimethyl" should read --dihexadecyldimethyl--.

Column 1, line 36, "melecules" should read --molecules--.

Column 1, line 49, before the period insert --or more particularly, "reference base color units"--.

Column 3, line 15, "dihexadecylidimethyl" should read --dihexadecyldimethyl--.

Column 3, line 17, between "nium" and "chloride" insert --compounds, such as dihexadecyldimethyl ammonium--.

Column 4, line 18, "50 ppm" should read --500 ppm--.

Column 5, line 17, after "treated with" insert --an--.

Signed and Sealed this

*Tenth* Day of *June 1980*

[SEAL]

*Attest:*

SIDNEY A. DIAMOND

*Attesting Officer*

*Commissioner of Patents and Trademarks*